US006854444B2

(12) United States Patent
Plagge et al.

(10) Patent No.: US 6,854,444 B2
(45) Date of Patent: Feb. 15, 2005

(54) METHOD AND DEVICE FOR CONTROLLING A DRIVE UNIT

(75) Inventors: Frank Plagge, Markgroeningen (DE); Ralf Dunke, Karlsruhe (DE); Torsten Bauer, Vaihingen (DE); Frank Bederna, Crespellano (IT); Berthold Steinmann, Asperg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/333,956

(22) PCT Filed: Jul. 17, 2001

(86) PCT No.: PCT/DE01/02690

§ 371 (c)(1),
(2), (4) Date: Jan. 27, 2003

(87) PCT Pub. No.: WO02/08595

PCT Pub. Date: Jan. 31, 2002

(65) Prior Publication Data

US 2003/0183193 A1 Oct. 2, 2003

(30) Foreign Application Priority Data

Jul. 26, 2000 (DE) ..... 100 36 282

(51) Int. Cl.[7] ..... F02D 41/10

(52) U.S. Cl. ..... 123/350; 123/399; 123/492; 123/493

(58) Field of Search ..... 123/350, 399, 123/492, 493

(56) References Cited

U.S. PATENT DOCUMENTS

| | | | | | |
|---|---|---|---|---|---|
| 5,484,351 | A | | 1/1996 | Streib et al. | 477/113 |
| 5,692,472 | A | | 12/1997 | Bederna et al. | 123/350 |
| 5,931,136 | A | * | 8/1999 | Isobe et al. | 123/399 |
| 6,035,825 | A | * | 3/2000 | Worth et al. | 123/493 |
| 6,076,500 | A | | 6/2000 | Clement et al. | 123/362 |
| 6,220,221 | B1 | * | 4/2001 | Flinspach et al. | 123/492 |
| 6,220,226 | B1 | * | 4/2001 | Alm et al. | 123/492 |
| 6,223,721 | B1 | * | 5/2001 | Bauer et al. | 123/492 |

FOREIGN PATENT DOCUMENTS

| | | |
|---|---|---|
| DE | 197 41 565 | 4/1999 |
| DE | 198 14 743 | 10/1999 |
| DE | 199 63 759 | 7/2001 |
| WO | WO 99/13207 | 3/1999 |
| WO | WO 99 23379 | 5/1999 |

* cited by examiner

*Primary Examiner*—Erick Solis
(74) *Attorney, Agent, or Firm*—Walter Ottesen

(57) ABSTRACT

A method and an arrangement for controlling a drive unit are suggested wherein a maximum permissible value of an output quantity is determined. This maximum permissible value is compared to the actual value and, when the permissible value is exceeded by the actual value, reaction measures are initiated. The maximum permissible value is filtered at least in one operating state in accordance with filter means including a filter and a dead zone member. Furthermore, the maximum permissible value is continuously reduced in dependence upon the approaching of at least one quantity to a limit value. This quantity represents an operating state.

11 Claims, 4 Drawing Sheets

METHOD AND DEVICE FOR CONTROLLING A DRIVE UNIT

This application is the national stage of PCT/DE01/02690, filed Jul. 17, 2001, designating the United States.

FIELD OF THE INVENTION

The invention relates to a method and an arrangement for controlling a drive unit.

BACKGROUND OF THE INVENTION.

A method and an arrangement of the above kind are disclosed in DE 195 36 038 A1 (U.S. Pat. No. 5,692,472). There, in the context of the control of a drive unit of a motor vehicle, for monitoring purposes, a quantity, which represents an output quantity of the drive unit, is compared to a maximum permissible value, which is pregiven for this quantity. Fault reaction measures are initiated when the quantity exceeds the pregiven permissible value. Examples of the output quantity of the drive unit are: the power of the drive unit or a torque of the drive unit, for example, the indicated torque, the output torque, et cetera. In one embodiment, the computer, which executes the control of the drive unit, includes at least two mutually separate program levels. The described comparison for monitoring purposes is computed in the second program level. The first program level is reserved for programs which compute the functions provided for the control of the drive unit. In another embodiment, a limiting of the input value to the maximum permissible value is undertaken in the first program level. This input value controls the drive unit.

For determining the maximum permissible value, and when no drive command of the driver is present, in general, the largest occurring value of the output quantity, which can be adjusted by the idle control, is inputted. In this way, an unlimited drivability is ensured. Especially in vehicles having small motors, low rolling resistance or a low inner friction, consumers such as a climate control compressor, a torque converter, et cetera, operate greatly on the output quantity of the drive unit so that, with respect to drivability, relatively large permissible values are to be inputted.

To improve the accuracy of the determination of the permissible value of the output quantity, and according to U.S. Pat. No. 6,076,500, an expansion of the maximum permissible value is undertaken for the restart phase for a cold drive unit, whereby, in this region, ancillary functions can operate uninfluenced and simultaneously, outside of this region, a relatively precise determination of the maximum permissible value and therefore a large effectivity is achieved for the fault detection. However, with this method, only two operating states are distinguished.

From the not published German patent application 199 63 759.8 of Dec. 30, 1999, it is known, for determining the permissible value, to compute a weighting with the maximum permissible driver command between a maximum permissible and a minimum permissible value. Here, the permissible requirements of the consumer and of the idle controller are additionally checked via a separate path and considered. With a defective computation of these components, these components are limited.

The described known solutions do not provide optimal results in all cases.

SUMMARY OF THE INVENTION

With the use of the so-called splines, a continuous smooth reduction of the permissible values of the output quantity is achieved in an advantageous manner in critical operating states of the engine. In comparison to a conventional bit-controlled reduction, this affords the advantage that the reduction does not take place in a jump-like manner and so the danger of vibrations and load impacts, which are often perceived by the driver as too violent, is avoided.

The reduction of the permissible values of the output quantity takes place in a preferred embodiment in each case of a fault; in other embodiments, only in selected faults at least when faults, which increase the output quantity, are perceived as especially disturbing by the driver, that is, for a released accelerator pedal and an rpm above the idle rpm; and/or when the brakes are depressed.

In the reduction of the permissible values of the output quantity, a characteristic line is utilized which is dependent upon engine rpm and is carried out in such a manner that the permissible values of the output quantity reach the value zero for greatly increased rpm. In this way, acceptable fault reactions are obtained even for light-running engines.

It is especially advantageous that the permissible value of the output quantity is reduced when the brake is depressed and the vehicle can be easily braked in the case of a fault.

The introduction of a dead time when filtering the permissible values of the output quantity is of special advantage because, in this way, the intake manifold dead time of the intake system is considered. This leads to a simplified application of the utilized filter constant and leads to the situation that a possibly present dashpot function is not limited.

Furthermore, in an advantageous manner, a more rapid fault reaction is achieved via an initialization of this filter with the reduction of the pedal path. This is especially true for a fault wherein a maximum driver command is pregiven. With this fault, an acceleration up to the maximum rpm can occur, the improved filtering reduces such overshoots. The tendency to vibration of the engine in the case of a fault is significantly reduced with the initialization via the reduction of the pedal path.

Special advantages are provided in systems wherein permissible values of the output quantity are formed in two program levels, the level 1 and the level 2. The reduction of the permissible values of the output quantity by means of splines is carried out only in level 1, so that the complexity of application is clearly reduced. Furthermore, a significantly more rapid fault reaction is reached especially in level 1 with the initialization of the filter by means of the pedal path signal; whereas, the overshoots in the level 2 are reduced for the above-mentioned fault.

Especially advantageous is furthermore a consideration of additional torque requests in the cold start, for example, for switching in additional consumers or control functions. This leads to an improved availability while simultaneously improving the accuracy of the monitoring.

BRIEF DESCRIPTION OF THE DRAWINGS

The invention will be explained in greater detail with reference to the embodiments shown in the drawing.

DESCRIPTION OF THE PREFERRED EMBODIMENTS OF THE INVENTION

Figure 1:
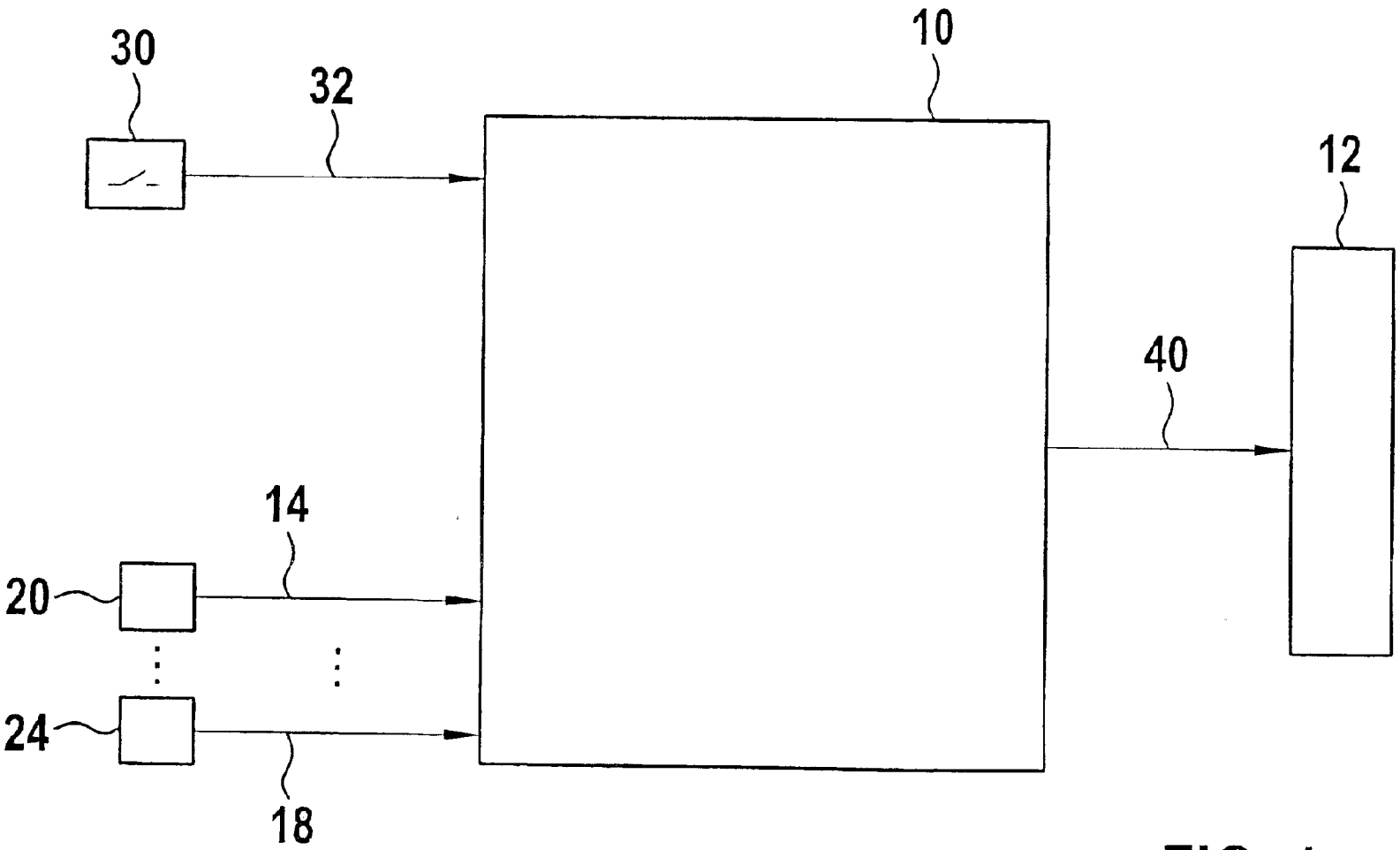
FIG. 1 shows a block circuit diagram of a control unit for controlling the drive unit of a vehicle.

FIG. 1 shows a control unit 10 for controlling a drive unit 12. The control unit 10 includes at least a computer including a memory wherein the programs are stored which serve for controlling the drive unit 12. For executing these programs, operating variable signals of the drive unit and/or of the vehicle are inputted to the computer via input lines 14 to 18 from corresponding measuring devices 20 to 24. These operating variable signals are evaluated by the computer and are considered in the formation of the at least one actuating signal for the drive unit 12. Such operating variable signals are, for example, signals which represent the engine temperature, accelerator pedal position, et cetera.

The input quantities, which are supplied to the control unit 10, are converted into at least one actuating quantity by means of the programs running in the computer. This actuating quantity controls at least one condition variable of the drive unit 12 in the sense of the input variables via at least one output line 40 of the control unit 10. In the preferred embodiment, a desired torque is determined as a desired value for an output quantity from the input quantities, especially the accelerator pedal position and engine rpm. This desired value is converted into drive signals for controlling the throttle flap position, the ignition angle and/or the engine temperature, et cetera, of an internal combustion engine. The torque of the engine (that is, its output quantity) approaches the pregiven desired value.

In another embodiment, in lieu of a torque, the power of the drive unit, its rpm, et cetera, is correspondingly controlled as output quantity. The procedure described hereinafter is not only used in connection with an internal combustion engine but also with other types of drive units, for example, electric motors.

In the preferred embodiment, a partition of the programs into at least two levels is provided. Programs are assigned to the first level which carry out the control function as well as the above-mentioned desired value limiting; whereas, monitoring programs are assigned to the second level which likewise are described in the state of the art mentioned initially herein.

A maximum permissible value is determined in dependence upon the engine rpm for computing the maximum permissible value for the output quantity of the drive unit. The basis of the minimum value is defined by the maximum permissible values of the output quantity for a released pedal. These values are determined in dependence upon the engine rpm and are corrected by means of: a corrective value for the cold start phase, which is formed in dependence upon engine temperature and engine rpm; a corrective value for active catalytic converter heating function, which is likewise dependent upon rpm; and/or permissible consumer requirement values. The permissible consumer requirement values represent the maximum permissible requirement values of the active consumers and/or of a power stabilizing function. These values are put together to the minimum permissible output quantity value. For determining the maximum permissible value of the output quantity, which forms the basis for the comparison for monitoring, the maximum permissible value is weighted between the above-described minimum and maximum permissible values, preferably interpolated. This maximum permissible value was determined from the accelerator pedal position and the engine rpm in accordance with a characteristic field.

In this way, a precise determination of the maximum permissible value of the output quantity of the drive unit is obtained which forms the basis of the monitoring mentioned initially herein. The described procedure takes place with the formation of the maximum permissible values in the level 1 as well as in the level 2.

In the case of a fault, the permissible values of the output quantity are made more sharp, that is, reduced. This sharpening does not take place in a jumplike manner, but continuously and smoothly via so-called splines. These splines permit transition states to be defined so that not only black/white conditions are present but also gray zones. Splines of the first order have the following general formula wherein the input quantity is the variable X, the output quantity is the variable Y and the transition region is identified by $\epsilon$:

$$Y = \begin{cases} 1 & \text{for } X > \varepsilon \\ X/\varepsilon & \text{for } 0 \le X \ge \varepsilon \\ 0 & \text{for } X < \varepsilon \end{cases}$$

The output signals of several splines can be logically coupled to each other like bits. A multiplication defines a logic AND coupling, an addition defines a logic OR coupling.

In addition to splines of the first order, also splines of higher order can be used which, however, represent an increased complexity of computation. As an example for a spline of the second order, the following general equation is mentioned:

$$Y = \begin{cases} 1 & \text{for } X > \varepsilon \\ 3X^2/\varepsilon^2 - 2X^3/\varepsilon^3 & \text{for } 0 \le X \ge \varepsilon \\ 0 & \text{for } X < \varepsilon \end{cases}$$

With a spline of the second order, continuity in the first derivation is also ensured. The danger that vibrations can be excited is thereby still further minimized.

In the present application, the splines are used in order to be able to better control the permissible value in specific operating states and to reduce. Such an operating state is present when the pedal angle is 0, that is, the accelerator pedal is released and/or the brakes are depressed, when the rpm is greater than the idle desired rpm and/or when the air desired torque or ignition desired torque exceed the maximum permissible torques.

The last condition is only present in a preferred embodiment and can be omitted in other embodiments.

A fault indicator is obtained from the logic coupling of these conditions with the splines. If one of the input quantities of the spline approaches its limit up and into the applicable gray zone, then the affected spline supplies values between 0 and 1. The fault indicator then supplies values different from 0 when all conditions are located at least in their gray zones. Dependent upon the value of the fault indicator, a value, which is to be applied, is subtracted from the permissible output quantities. If all conditions are satisfied, the value of the fault indicator is 1. Then the largest applied value is subtracted from the permissible values and the fault reaction is, in this way, more controllable.

Furthermore, a dead time is introduced in the determination of the permissible values in addition to the filtering. This dead time considers the intake manifold performance. Filter and dead time are initialized by a reduction of the pedal path. Furthermore, the minimum charges of an internal combustion engine are considered in the determination of the permissible value in accordance with the description which follows.

Figure 2:
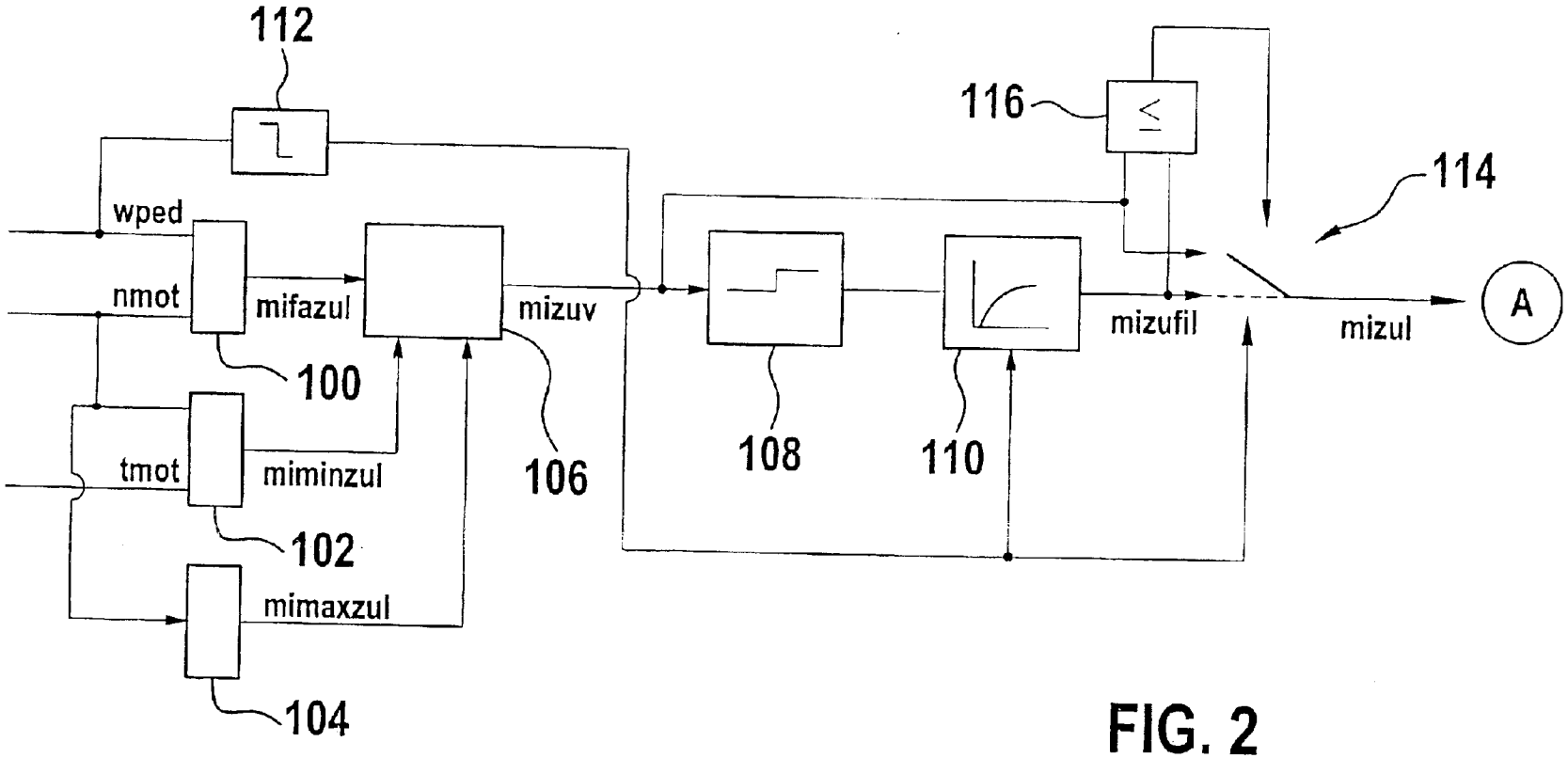
In FIGS. 2 and 3, sequence diagrams are shown, which define preferred embodiments for determining the maximum permissible value of the output signal of the drive unit, especially the torque thereof.
Figure 3:
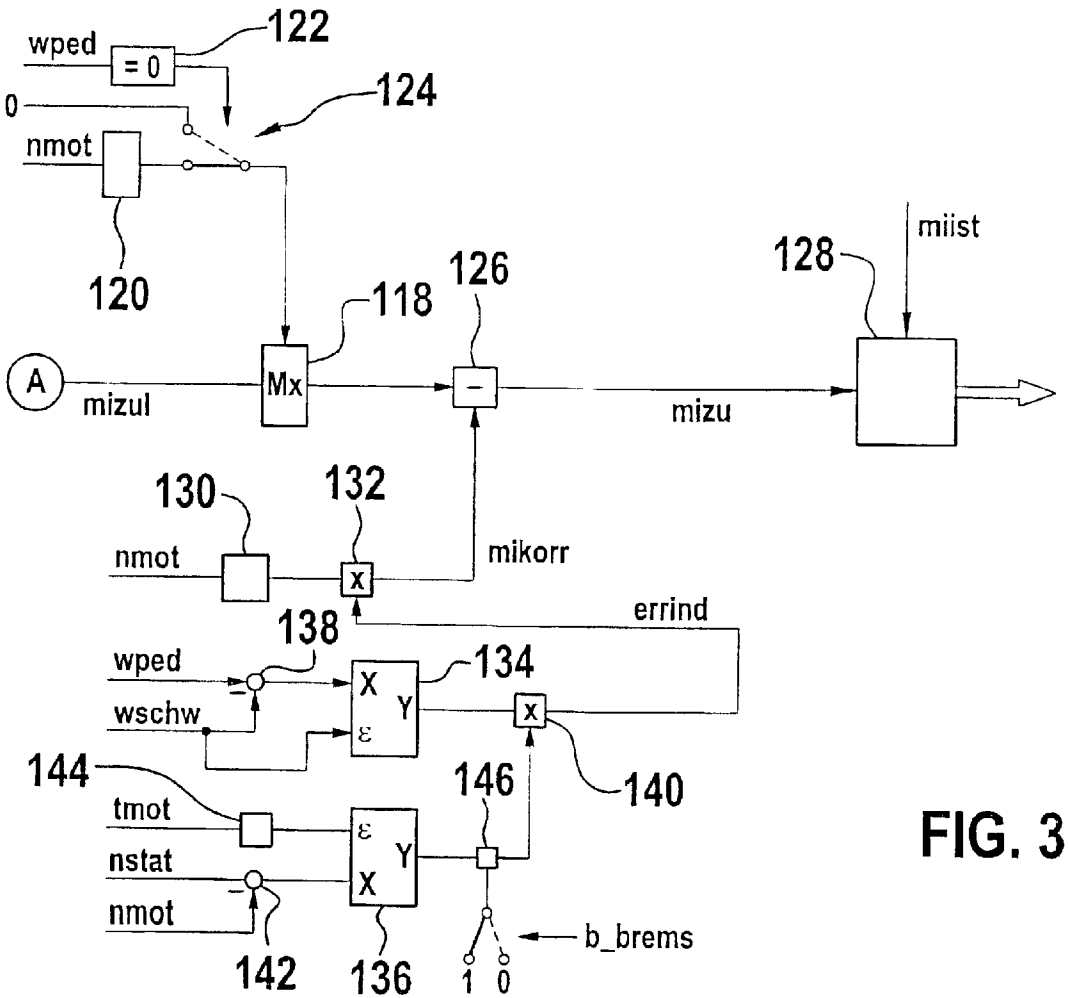

Sequence diagrams are shown in FIGS. 2 and 3 and these sequence diagrams define a preferred embodiment for determining the maximum permissible value of the output quantity, in the preferred embodiment, of the maximum permissible torque. The individual blocks identify programs, program parts or program steps, while the connecting lines represent the flow of information.

From the supplied quantities "pedal position WPED" and "engine rpm Nmot", the maximum permissible driver command torque MIFAZUL is formed in a first characteristic field 100. Furthermore, a minimum permissible torque MIMINZUL is formed in dependence upon the engine rpm and the engine temperature Tmot in 102; whereas, in 104, a maximum permissible maximum torque MIMAXZUL is determined, for example, on the basis of the engine rpm.

The determination of the minimum and maximum permissible torques is essentially known from the state of the art mentioned initially herein. In a preferred embodiment, the maximum permissible torque is formed from the smaller value of the maximum permissible torque, which is read out of the characteristic line in dependence upon rpm, and of the maximum torque which actually occurred in the past.

For the minimum torque, a cold start amount is additively superimposed in dependence upon the engine temperature additionally in the cold start. Depending upon the engine temperature, time-dependent filtered differently sized components are considered. In this way, the maximum permissible torque is expanded in the cold start so that the availability of the vehicle is less intensely limited in this region.

In 106, a preliminary value of the maximum permissible torque MIZUV is formed in accordance with the weighting of the maximum permissible, relative driver desired command torque MIFAZUL and between the minimum and maximum permissible torques. The preliminary maximum permissible torque MIZUV is supplied to a dead time member 108. The dead time is orientated on the dead time of the intake manifold system of the internal combustion engine or corresponds to this dead time. After the dead time member, the preliminary permissible torque is then supplied to a lowpass filter 110 and is there filtered. The output signal is the filtered maximum permissible torque MIZUFIL. The filtering is initialized when a pullback of the accelerator pedal was recognized. This takes place via a corresponding threshold value switch 112 to which the pedal position signal WPED is supplied. The switch 112 generates an output signal when the accelerator pedal is pulled back, that is, for example, when this drops below a threshold value. The output signal leads, on the one hand, to an initialization of the filter 110 with the preliminary maximum permissible value as well as to a switchover of the switch element 114 into the position shown by the broken line. This position means that the filtered maximum permissible value is outputted. Further, it is provided that the filter 110 is to be initialized when external torque requests are present, for example, requests of an engine drag torque controller, a drive slip controller, et cetera. In this case, the pullback of the preliminary maximum permissible torque MIZUV is evaluated as a second initialization quantity in lieu of the pullback of the accelerator pedal position. Furthermore, in a comparison element 116, the filtered maximum permissible torque MIZUFIL is compared to the unfiltered MIZUV. If the unfiltered is less than the filtered, then the switch element 114 is switched over into the position shown by the solid line via the output line of the comparator element 116. This means that the unfiltered torque is transmitted further rather than the filtered maximum permissible torque.

In a corresponding manner, the dead zone member 108 is initialized with the preliminary value.

As a rule, the unfiltered maximum permissible torque is transmitted for further processing insofar as no pullback of the accelerator pedal was detected. In this case, the maximum permissible torque is filtered because the pullback of the accelerator pedal becomes noticeable only after a specific dead time with delay of the torque. To prevent that too rapid a reduction of the maximum permissible torque occurs and therefore a fault reaction occurs too rapidly, the filtered maximum permissible torque is transmitted via the dead zone member 108 and the filter 110. With the initialization of the dead zone member and filter, the unfiltered torque is set as starting point. As soon as the filtered torque is less than the unfiltered torque, the unfiltered torque is transmitted again.

The permissible torque MIZUL, which is formed in this manner, is then processed further in accordance with FIG. 3. In FIG. 3, the continuous reduction of the maximum permissible torque for specific operating situations is shown. The initially mentioned splines are used. First, the maximum permissible torque value is, however, supplied to a maximum value selection stage 118, wherein a value, which is dependent upon the engine rpm Nmot, is compared to the maximum permissible value and the value which is greater is transmitted further. The value which is dependent upon the engine rpm Nmot is formed by means of a characteristic line 120 and represents the minimum charge of the internal combustion engine. If the accelerator pedal is released, that is, the accelerator pedal position is equal to 0, then a signal is outputted from the signal transducer 122 which sets the switch element 124 in the position shown by the broken line and the value zero is supplied to the maximum value selector 118. The maximum permissible torque, which is possibly limited in this manner, is then supplied to a difference position 126 wherein a continuously changeable value is subtracted in the corresponding operating conditions and, in this way, the maximum permissible torque is reduced. The output signal of the difference stage 126 is the maximum permissible torque MIZU, which is compared to the actual torque MIACT in a comparator position 128. When the maximum possible torque is exceeded by the actual torque, fault reaction measures are initiated, for example: a limiting of the torque desired value, a switchoff of the fuel metering, et cetera.

To determine the reduction factor, which is considered in the difference stage 126, the-above-mentioned splines are utilized. In FIG. 3, a preferred embodiment is shown wherein a reduction takes place when the accelerator pedal is released (pedal angle WPED equal to 0) or the brake is depressed or the engine rpm Nmot is greater than the steady state desired rpm. Also, in one embodiment, the desired torques for the air path and ignition angle path are compared to pregiven limit values. When the permissible value is exceeded by one of the two desired torques, a reduction of the maximum permissible torque likewise takes place. The realization with splines is correspondingly undertaken. The desired torques form additional criteria. In a characteristic line 130, a corrective factor for the maximum permissible torque is formed in dependence upon the engine rpm. This corrective factor is multiplied in the multiplication position 132 by a value between 0 and 1. The corrective value MICORR, which is weighted in this manner, is supplied to the difference position 126. Furthermore, in FIG. 3, two spline functions 134 and 136 are shown, which operate in accordance with the above-given formula for a spline of the first order, and, in another embodiment, for a spline of the second order. The input quantity of the spline 134 is formed from the difference between the pedal path WPED and a pedal threshold value WSCHW, which delimits the region of the released pedal position from the region of the depressed accelerator pedal. The difference is formed in the difference stage 138. The value ϵ is the threshold value WSCHW. The output quantity Y of the spline function 134 is logically coupled in a multiplication position 140 to the output value of the spline function 136. This logic coupling defines, as mentioned above, a logic AND coupling. Output quantity of the multiplication position 130 is the fault value ERRIND, which assumes values between 0 and 1. Values greater than 1 are limited to 1. The input quantity of the second illustrated spline 136 is the difference between the engine rpm Nmot and the steady state idle rpm Nstat, which is formed in the difference position 142. The value ϵ is determined in accordance with the characteristic line 144 in dependence upon engine temperature tmot. The value 1 is superposed on the output quantity Y of the spline 136 in an addition position 146 when the brake is actuated or, the value 0 is superposed when the brake is not actuated. The output value of the addition position 136 is supplied to the multiplication position 140.

In this way, and as mentioned above, a value is formed between 0 and 1 by the splines for the case that the input quantity thereof enters into the gray zone region ϵ. For input quantities below the gray zone region, the value 0 is the output quantity of the splines. If the value deviates from 0, then the corrective value, which is dependent upon the engine rpm, is superposed on the maximum permissible torque in the multiplier position 132 and is weighted in the accordance with the extent of the entry of the input quantities into the gray zone region. At the end of the gray zone region, when the threshold value is reached, the output value assumes the value 1. In this way, the maximum permissible torque is continuously reduced when approaching the above-mentioned operating states.

Figure 4:
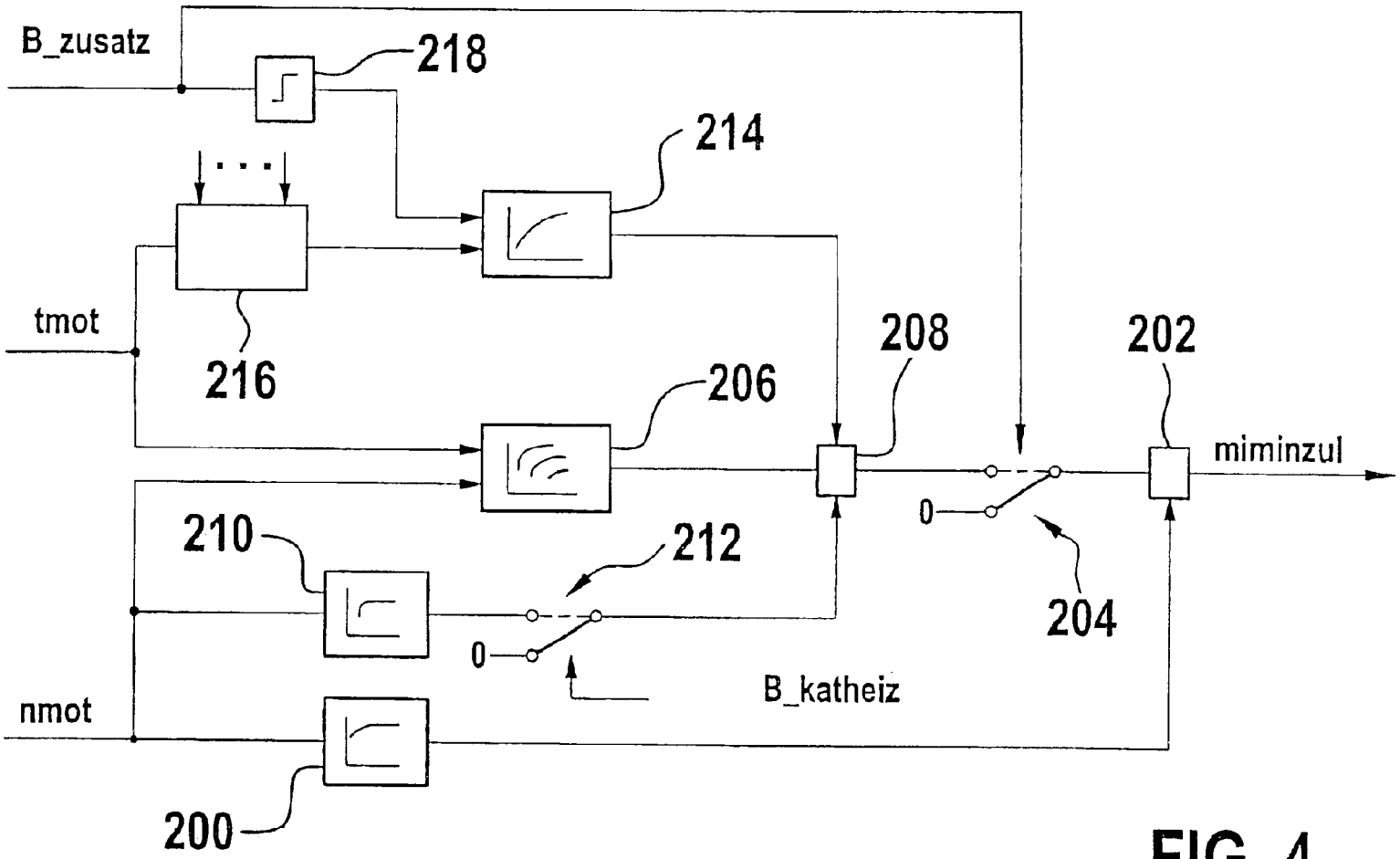
In FIG. 4, the consideration of additional torque requests during cold start in the computation of the minimum permissible torque is shown as a sequence diagram.

FIG. 4 shows a sequence diagram for determining the minimum permissible torque. Special measures for the cold start and the additional torque requirements are made in this operating state. The minimum permissible torque miminzul is pregiven in dependence upon the engine rpm Nmot, for example, by means of a characteristic line 200. A value which is different from zero, is superposed (preferably added) to this quantity in the logic position 202 when specific pregiven conditions are present. These are put together in the switch signal B_zusatz. This switch signal has a positive value when additional torque requests are present, for example, from additional consumers such as vacuum pumps, climate control systems, blower, headlights, generator, et cetera, which require additional torque, and/or additional functions which likewise lead to a torque increase of the drive unit such as a catalytic converter heating function. Preferably, the switch signal B_zusatz is only set to a positive value when such a torque request occurs during the cold start phase or the after-start phase. If the switch signal has a positive value, the switch element 204 is switched into the position shown by the broken line. In this operating state, a value, which is formed in dependence upon rpm and engine temperature, is superposed on the rpm-dependent value in the logic position 202. The value, which is formed in dependence upon rpm and engine temperature is, for example, formed in dependence upon engine rpm Nmot and engine temperature tmot in characteristic field 206. The value considers the additionally occurring losses for a cold engine, for example, caused by increased friction. On this value, for additional torque requests, values are superposed (preferably added) in the logic position 208. These values consider the additional torque requests. For active catalytic heating function (condition B_katheiz satisfied), a further rpm-dependent value is superposed in the logic position 208. This value is, for example, determined in a characteristic line 210 in dependence upon the engine rpm Imot and superposed when the switch element 212 is disposed in the position shown by the broken line and the abovementioned condition is present.

A further value, which is to be superposed in the logic position 208, is formed in filter 214. The filter 214 preferably defines a lowpass filter, wherein an engine temperature dependent value, which is formed in 216, is filtered. In 216, the engine temperature tmot is read in and is set in relationship to a fixed temperature value TNS and, if required, is weighted with additional pregiven quantities. The temperature value defines a limit value which delimits the operating state of the cold start from other states. In the preferred embodiment, the signal dm_zusatz, which is supplied to the filter, is formed as follows:

$$dm_zusatz=(TNS-tmot)*dmzul/\Delta mns$$

wherein dmzul and Δmns are fixedly pregiven weighting quantities.

The lowpass filter is configured in such a manner that a filtering only takes place when a positive flank was detected in the condition signal B_zusatz (see 218), that is, only with the occurrence of a new torque request. The value dm_zusatz, which is present at this time point, is filtered at a specific time constant. Changes of this value after the above-mentioned time point are not considered. The filtered value dm_zusatz therefore defines a time-dependent filtered engine temperature-dependent component (cold start amount).

The described determination of the minimum permissible torque takes place in level 1 as well as in level 2.

The measures, which are defined in the context of the above description, are applicable depending upon the embodiment individually or in any combination and include the following: the consideration of splines; the filtering of the maximum permissible value; the formation of the cold start amount for the minimum permissible torque; and, the consideration of the minimum charge.

What is claimed is:

1. A method for controlling a drive unit having an output quantity, the method comprising the steps of:

determining a maximum permissible value of said output quantity;

initiating measures when the instantaneous value of said output quantity exceeds said maximum permissible value;

forming said maximum permissible value on the basis of an accelerator pedal position; and, filtering said maximum permissible value in at least one operating state in accordance with the dynamic of an intake manifold of an internal combustion engine with said filtering including a dead zone member which represents the dead time in said intake manifold.

2. The method of claim 1, wherein a filter and/or the dead zone member are initialized when a pullback of the accelerator pedal is detected.

3. The method of claim 1, wherein the maximum permissible value is:

the filtered value when a pullback of the accelerator pedal is detected, and the filtered value is not less than the unfiltered value; and the unfiltered value when the filtered value is less than the unfiltered value.

4. A method for controlling a drive unit having an output quantity, the method comprising the steps of:

determining a maximum permissible value of said output quantity;

initiating measures when the instantaneous value of said output quantity exceeds said maximum permissible value; and, continuously reducing said maximum permissible value in dependence upon a distance of at least one variable from a limit quantity with said variable indicating a specific operating state.

5.The method of claim 4, wherein splines are utilized for determining a reduction quantity.

6. The method of claim 4, wherein the permissible value is reduced when an accelerator pedal is released or a brake is depressed and an engine rpm is greater than a desired rpm at idle.

7. The method of claim 4, wherein a limit quantity is formed for an accelerator pedal position and/or a difference between engine rpm and desired rpm and, when the limit quantity is approached, an output quantity is determined which becomes greater with increased closeness and which operates on the corrective value for reducing the maximum permissible value.

8. A method for controlling a drive unit having an output quantity, the method comprising the steps of:

determining a maximum permissible value of said output quantity;

initiating measures when an instantaneous value of said output quantity exceeds said maximum permissible value; and, determining said maximum permissible value in dependence upon at least one of a minimum charge and a minimum value which is formed utilizing an engine-temperature dependent value when an additional torque request is present.

9. An arrangement for controlling a drive unit having an output quantity, the arrangement comprising:

a control unit including:

means for forming a maximum permissible value for said output quantity;

means for initiating reaction measures when an instantaneous value exceeds said maximum permissible value;

filter means for filtering said maximum permissible value; and, said filter means including a dead zone member derived from an intake manifold dead time.

10. An arrangement for controlling a drive unit having an output quantity, the arrangement comprising:

a control unit including:

means for forming a maximum permissible value for said output quantity;

means for initiating reaction measures when an instantaneous value exceeds said maximum permissible value; and, correcting means for continuously reducing said maximum permissible value in dependence upon a distance of at least one variable from a limit quantity with said variable indicating a specific operating state.

11. An arrangement for controlling a drive unit having an output quantity, the arrangement comprising:

a control unit including:

means for forming a maximum permissible value for said output quantity;

means for initiating reaction measures when an instantaneous value exceeds said maximum permissible value; and, means for determining said maximum permissible value in dependence upon at least one of a minimum charge and a minimum value which is formed utilizing an engine-temperature dependent value when an additional torque request is present.

* * * * *